US007946146B2

(12) United States Patent
Hartl

(10) Patent No.: US 7,946,146 B2
(45) Date of Patent: May 24, 2011

(54) HYDROFORMING APPARATUS

(75) Inventor: Christoph Hartl, Paderborn (DE)

(73) Assignee: Fachhochschule Koeln, Cologne (DE)

( * ) Notice: Subject to any disclaimer, the term of this patent is extended or adjusted under 35 U.S.C. 154(b) by 96 days.

(21) Appl. No.: 12/443,718

(22) PCT Filed: Sep. 28, 2007

(86) PCT No.: PCT/EP2007/008459

§ 371 (c)(1),
(2), (4) Date: May 14, 2009

(87) PCT Pub. No.: WO2008/040497

PCT Pub. Date: Apr. 10, 2008

(65) Prior Publication Data

US 2009/0320543 A1 Dec. 31, 2009

(30) Foreign Application Priority Data

Oct. 2, 2006 (DE) ..... 10 2006 047 017

(51) Int. Cl.
*B21D 39/08* (2006.01)
*B21D 9/15* (2006.01)
*B21D 26/02* (2006.01)

(52) U.S. Cl. ..... 72/58; 72/62; 72/370.22; 29/421.1

(58) Field of Classification Search ..... 72/58, 60, 72/61, 62, 370.22; 29/421.1
See application file for complete search history.

(56) References Cited

U.S. PATENT DOCUMENTS

| | | | | |
|---|---|---|---|---|
| 1,501,023 | A | 7/1924 | Goodspeed | |
| 5,233,854 | A * | 8/1993 | Bowman et al. | 72/58 |
| 6,591,650 | B2 * | 7/2003 | Engel et al. | 72/58 |
| 7,231,793 | B2 * | 6/2007 | Sohn et al. | 72/61 |
| 7,380,429 | B1 * | 6/2008 | Ghiran et al. | 72/58 |
| 7,392,679 | B1 * | 7/2008 | Ghiran et al. | 72/58 |
| 7,685,856 | B1 * | 3/2010 | Ghiran et al. | 72/61 |

FOREIGN PATENT DOCUMENTS

| | | |
|---|---|---|
| DE | 102004017235 | 3/2006 |
| FR | 847257 | 10/1939 |
| JP | 2004276077 | 10/2004 |
| JP | 2006122943 | 5/2006 |
| WO | WO-9925506 | 5/1999 |
| WO | WO 0187510 | 11/2001 |

* cited by examiner

*Primary Examiner* — David B Jones
(74) *Attorney, Agent, or Firm* — Andrew Wilford

(57) ABSTRACT

The invention relates to a device for the internal high-pressure forming of components from tubular workpieces, in particular microcomponents, comprising an at least two-part mould, in which a workpiece can be placed, and means for sealing and/or applying pressure to the workpiece at the ends of the workpiece, in which device at least one guide (11) is arranged on the mould (2*a*, 2*b*), on which guide a carriage (12) is displaceable, which carriage carries means (4, 5) for sealing and/or filling/applying pressure to a workpiece end (1*a*), wherein a carriage (12) is displaceable by means of a drive (13, 15) which is arranged separately from the at least one guide (11) and is coupled to the carriage (12) at least essentially such that it is free from transverse forces.

19 Claims, 6 Drawing Sheets

HYDROFORMING APPARATUS

CROSS REFERENCE TO RELATED APPLICATIONS

This application is the US national phase of PCT application PCT/EP2007/008459, filed 28 Sep. 2007, published 10 Apr. 2008 as WO2008/040497, and claiming the priority of German patent application 102006047017.6 itself filed 2 Oct. 2006, whose entire disclosures are herewith incorporated by reference.

FIELD OF THE INVENTION

The invention relates to an apparatus for hydroforming parts from tubular workpieces, particularly microcomponents, comprising an at least two-part die into which a workpiece can be inserted, and means for sealing and/or applying pressure to the workpiece at its ends.

BACKGROUND OF THE INVENTION

Such apparatuses are generally known for traditional parts from the state of the art. Typically, such apparatuses are used to expand primarily metal tubular workpieces by internal fluid pressurization, frequently a liquid. Due to the confinement in a die, the expansion expands the wall of the workpiece until it rests against a contoured inside wall of a die. The contoured inside wall, which is also referred to as the die engraving, thus defines the eventual outer shape of a workpiece to be hydroformed.

A known apparatus for carrying out such a hydroforming processes typically comprises an at least two-part die that can be opened in order to load a tubular workpiece for the forming process. After closing the die, particularly by pressing an upper die part onto a lower die part, the means for sealing and filling/pressurizing are pressed against the open workpiece ends and the workpiece is deformed by the internal pressure that is thus produced. After such a forming step, and particularly the removal of the means mentioned above, the die can be opened and the formed workpiece can be removed.

Such hydroforming processes subject parts of the apparatus and tool to elastic deformation during the hydroforming process as a result of the comparatively high loads and pressures used for hydroforming. Such deformations can have an impact both on the dies and on the workpieces and adjoining parts of the apparatus.

Such deformations in particular can result in elastic compression of the dies, since an upper die part must be pressed against the lower die part with a die-closing force that is proportional to the internal pressure. As a result, a displacement, particularly a parallel displacement of the die and the workpiece inserted therein relative to other external parts of the apparatus may occur, for example by the means for sealing, such as plugs, or the means for filling and pressurizing that are pressed from the outside against the die or the tool ends during the forming operation.

In this way, process reliability may be reduced, for example due to reduced sealing properties of the means for sealing or filling/pressurizing. Likewise, wear may also be increased or dies may break.

In order to counteract this, it is already known to directly attach actuators for moving the means for sealing or filling and pressurizing the die. However, since the actuators therefore are directly supported on the die, the introduction of the stresses occurring during forming directly into the die causes tension and deformations, which likewise impair process reliability. For example, the weight of the actuators carried by the die can skew the means for sealing and/or filling/pressurizing. In addition, with such a solution the actuators are very complex to disassemble or reassemble when replacing the dies.

These problems mentioned above result in the fact that known apparatuses of the type described cannot be used for hydroforming microparts, such as tubular workpieces with dimensions, for example, of less than 3 mm in diameter, preferably less than 1 mm in diameter, because on such small workpieces the deformations have a stronger effect relative to the workpiece size than in conventional workpiece sizes. To this end, ratios of the wall thickness to the diameter of 0.02 to 0.2 can be used for microparts.

OBJECT OF THE INVENTION

It is the object of the invention to create an apparatus of the type described above, in which the disadvantages described above are reduced or overcome and thus inevitable elastic deformations have no negative impact.

SUMMARY OF THE INVENTION

The object is attained according to the invention by an apparatus of the above-described type, wherein the die is provided with at least one guide on which a slide is displaceable that carries means for sealing and/or for filling or feeding pressurized liquid to a workpiece end, wherein a slide can be displaced by an actuator that mounted separately from the guide and is coupled at least substantially to the slide free of lateral force.

A key idea is that by providing a guide on the die, during elastic deformation of the die as a result of a die-closing force displacement of the die due to the guide attached thereon at the same time also causes displacement of the guide such that the relative position between the guide and die is maintained.

Then, according to the invention, means for sealing and/or means for filling/pressurizing can be pressed tightly against the workpiece ends by a slide that can be displaced on this guide and can be moved in the direction toward an open workpiece end, for example by a suitable actuator. Such means can be mounted for this purpose on the slide.

Such a means, for example, can be a plug, which seals the workpiece at the open workpiece end against the internal pressure during the forming operation. Furthermore, it can be a nozzle, which just like a plug is placed and pressed against an open workpiece end and has a bore or a passage through which fluid, such as hydraulic liquid, can be pumped into the inside of the workpiece and pressurized.

Another key idea is that a slide can be displaced by an actuator mounted separately from the guide, the actuator being coupled to the slide at least substantially free of lateral forces. The arrangement of an actuator for the movement and pressing of a slide separate from the guide, and consequently also separately from the die, prevents any deformations or distortions that can occur due to stresses between the actuator and die. In this way, the disadvantages known from the prior art are prevented by this arrangement.

Furthermore, due to the coupling being at least substantially free of lateral forces, the action of force between the actuator and slide cause no, or substantially no lateral force transmission, but only force transmission in the direction of the possible displacement of the slide on/in the guide. The lateral forces that are not transmitted according to the invention shall therefore be understood as those forces that are effective perpendicular to the displacement direction of a slide, and therefore can contribute to a distortion or deformation at the die or at the connecting points between the workpiece ends and the means mentioned above.

Due to the substantially lateral force-free coupling between an actuator and a slide, no action of force is furthermore created perpendicular to the displacement direction between the actuator and the slide, even in the event of movement of the die and the guide, because decoupling exists for these forces. In addition, the actuator does not follow movement of a guide element.

According to the invention, The guide may advantageously be improved. For example, the guide can be mounted on at least one of the parts of the die. The lower part of a die is preferably selected such that the guide remains in place even if the upper die part is lifted off for demolding.

Furthermore, in a preferred embodiment each of the workpiece ends is associated with a guide having a slide and an actuator. As a result, it is possible to close each of the workpiece ends, of which typically at least two exist in tubular workpieces, according to the invention using the respectively necessary means, for example for sealing and/or for filling/pressurizing. To this end, the guides may be parallel, for example in the case of axial workpieces, and be aligned with each other, or they may also have an offset at both ends of the die. In the case of arcuate workpieces, the guides are oriented at an angle to each other.

The apparatus may preferably be configured such that a guide is oriented in the parting plane of the die. This ensures that the position of a guide relative to a workpiece end, which is typically located in the parting plane, is maintained, however large the deformation that results. As a result, at the same time also the position of the respective slide with the means mounted thereon for sealing and/or filling/pressurizing relative to the workpiece end remains the same.

In a particularly preferred embodiment, the arrangement of a guide is selected such that the guide extends through a die, particularly from one workpiece end to another workpiece end. In a workpiece having only two workpiece ends, in this way only a single guide may be provided, which on one end of the die guides a slide for receiving at least one of the means mentioned above and on the other end guides a further slide for receiving at least a second one of the means mentioned above, which is to say in particular on one end a plug for sealing and on the other end a nozzle for filling and pressurizing. By continuing the guide from one end of the die through to the other end, particular stability in the guide and to the die is achieved.

In one embodiment one guide comprises two rods that are parallel at least outside the die and that in particular pass through a slide. For example, they can be round rods, preferably of the manufacturing quality of drive shafts, on which a slide is guided by bearings. The opposite ends of each rod may not be oriented parallel but at an angle to each other, for example if one rod is aligned not exactly straight, but has a curvature/bend. In this case, also the displacement directions of two slides mounted on two ends of a die are not parallel to each other.

The apparatus is preferably selected such that, particularly in the case of axial tubular workpieces, the axes of two guides located on two ends of the die are coaxial, so that the force vectors, which due to the slides acts on the workpiece ends, are directed exactly opposite each other and compensate for each other.

According to the invention, an actuator, or at least a holder of an actuator, with a part, particularly a lower part of a die, is mounted on a common base plate, in particular a die-closing force being applied to an upper part of the die. To this end, the lower part of the die can be mounted directly on the base plate, or by an intermediate part. This has the advantage that all stresses, such as those for the die-closing force between upper and lower halves of a die and those for the contact pressure by the actuators, are absorbed by the base plate. This base plate can thus be configured in a correspondingly robust manner.

The die-closing force is applied by an actuator connected to the common base plate by a rack/frame arrangement. In this way, a closed flux of forces can be achieved.

According to the invention, the substantially lateral force-free coupling between an actuator and a slide is configured by loose contact between the slide and actuator. Loose contact in this invention shall be understood such that an element moving the slide in a direction toward the workpiece end, such as a ram, only rests against a face of a slide, but in particular is not connected thereto or attached thereon. To the extent that an attachment is provided, according to the invention it is to be configured free of lateral forces such that no forces are transmitted by this attachment in a direction, or with a part perpendicular to the displacement direction of a slide. Due to the contact between two faces of the actuator and the slide, the slide can be moved by the actuator in the advancement direction. In this way, a force is transmitted substantially only in the direction of advance. As a result of lateral force-free coupling, a force acting perpendicular thereto would only cause the contact point to change between the actuator and slide. In this way, some movement between the die and driving mechanism due to elastic deformation is possible without negative effect.

For the coupling between the actuator and slide, in the region of the loose contact means are used to reduce lateral force transmission and/or friction. In this way, the possibility of a transverse movement between the actuator and die or slide/guide is facilitated even further. For example, such a means may be configured as a roller and/or ball bearing, wherein in particular the rollers with a vertical die-closing force are oriented horizontally and perpendicularly to the slide movement between the respective faces of the actuator and slide. Due to these rollers, the faces of the actuator and slide, between which a force is transmitted in the advancement direction, can roll past each other vertically, which is to say in the direction of the effective and potentially deforming die-closing force. This decouples them from a potential lateral force vertically, and thereby provides the decoupling according to the invention.

BRIEF DESCRIPTION OF THE DRAWING

One embodiment of the invention is shown in the figures below. Therein:

FIG. 1 shows to start with an overview of the steps for performing a hydroforming operation of a tubular workpiece 1. The workpiece 1 is inserted into a lower part 2*a* of a die 2 and subsequently an upper die part 2*b*, which initially is raised as shown in FIG. 1*a*, is lowered onto the lower die part 2*a*, as shown in FIG. 1*b*. The closed die 2 has an cavity half 3, which is also referred to as die engraving and which defines the eventual outer shape of the formed workpiece 1.

After the die 2 is closed, here a plug 4 is placed against a workpiece end 1*a* on the right and a nozzle for filling and pressurizing on the left. To this end, the nozzle is formed with a passage 5*a*.

Figure 1B:
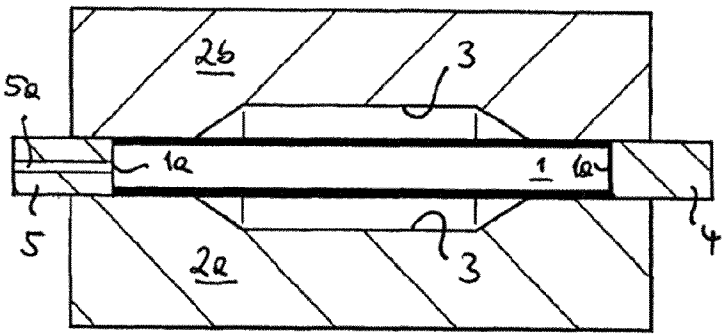
FIG. 1 shows the process steps during hydroforming.
Figure 1D:
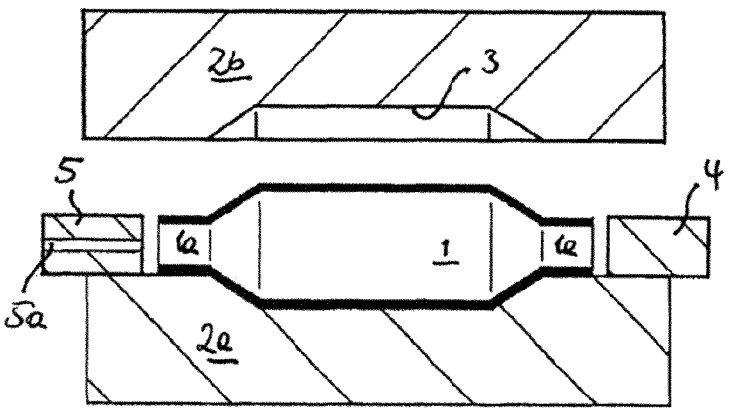
Figure 1A:
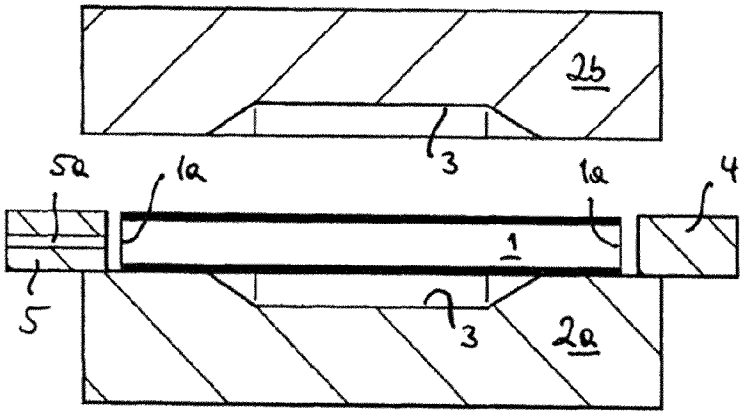
Figure 1C:
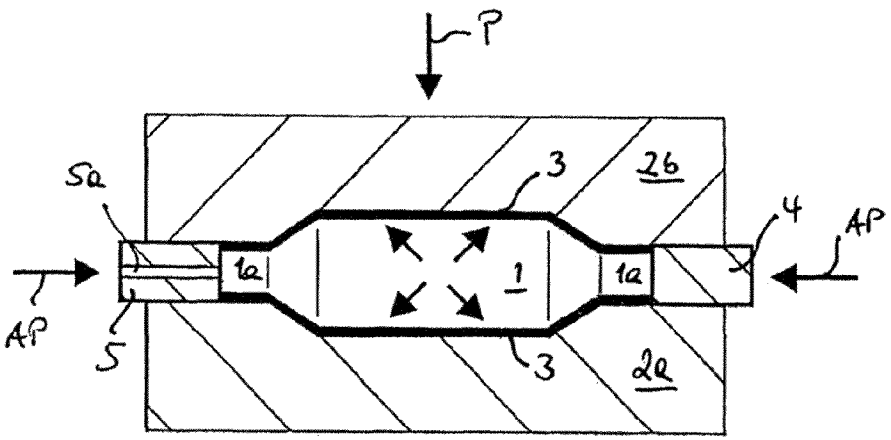

As shown in FIG. 1*c*, a vertical die-closing force P is applied to the die, and a contact pressure AP is applied to both of the rams 4 and 5. The nozzle fills the inside of the workpiece with a pressurized liquid such that the workpiece wall expands until it rests against the cavity half 3. The workpiece 1 is then formed and can be taken out by opening the die 2 and removing the rams 4 and 5, as shown in FIG. 1*d*.

Figure 2:
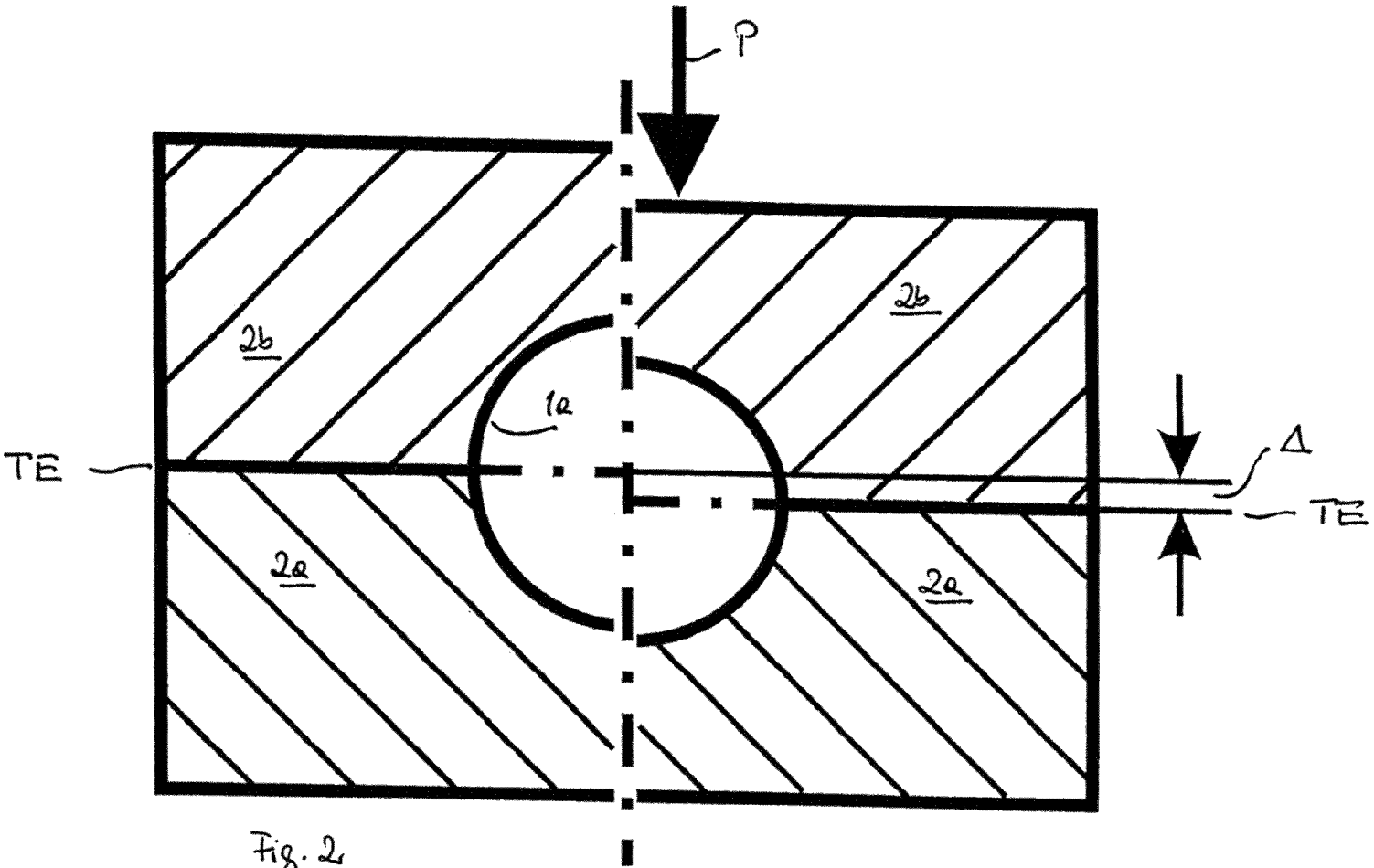
FIG. 2 illustrates the elastic compression of the die.

FIG. 2 illustrates the problem this creates. In the half of the die 2 on the left, the die 2 is shown in a closed and unstressed state along with a workpiece end 1*a*. The lateral ends of the die have an opening cross-section corresponding corresponds to the outside cross-section of a workpiece 1 to be inserted at the end 1*a*. On the right, the same situation is shown, however in the stressed state, which is to say with a die-closing force P applied to the die 2 from above by the die part 2*b*. It is apparent here that the parting plane TE between the two die halves 2*a* and 2*b* is displaced downward by to an extent Δ. This way, a leak may develop with respect to the rams 4 and 5 pressed against the ends.

Figure 3:
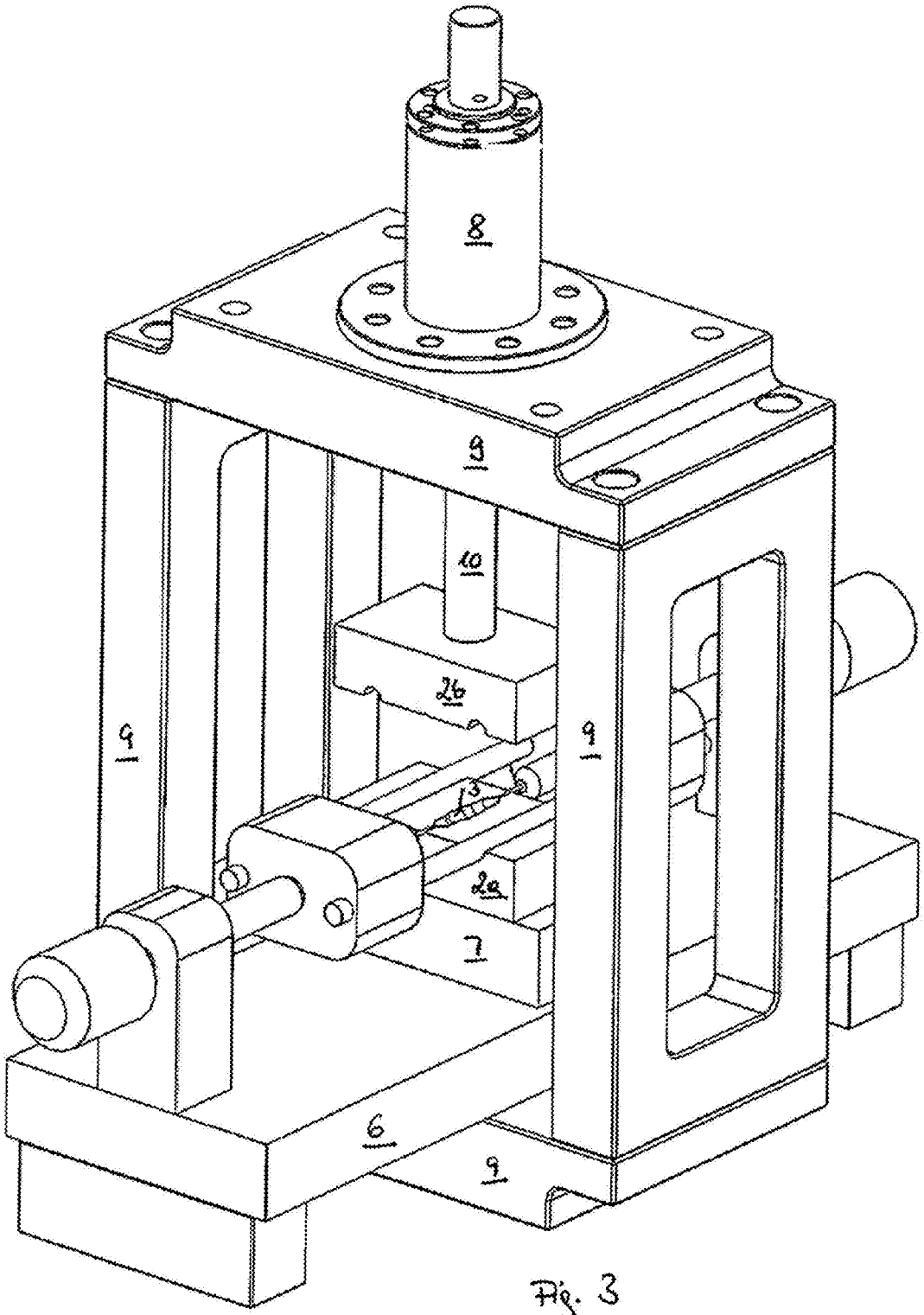
FIG. 3 is a perspective diagrammatic view of an apparatus according to the invention.

FIG. 3 shows an apparatus according to the invention from above. A lower die part 2*a* is mounted on a base plate 6 by an intermediate piece or support 7. In this view from above, the cavity half 3 of this lower part 2*a* is apparent.

An actuator 8 attached to the base plate 6 via a frame or rack 9 has a ram 10 that exerts the die-closing force against the upper die part 2*b* and moves it downward, and this die-closing force is maintained during the forming operation. Thereafter, the actuator 8 is used to open the die 2. The actuator ram 10 can be powered hydraulically or mechanically, for example by a toggle lever mechanism.

The frame or rack is used to absorb the process forces and forms a support for additional key parts of the apparatus. It may, for example, have bolted-together frame parts 9, or a welded or cast construction.

Figure 4:
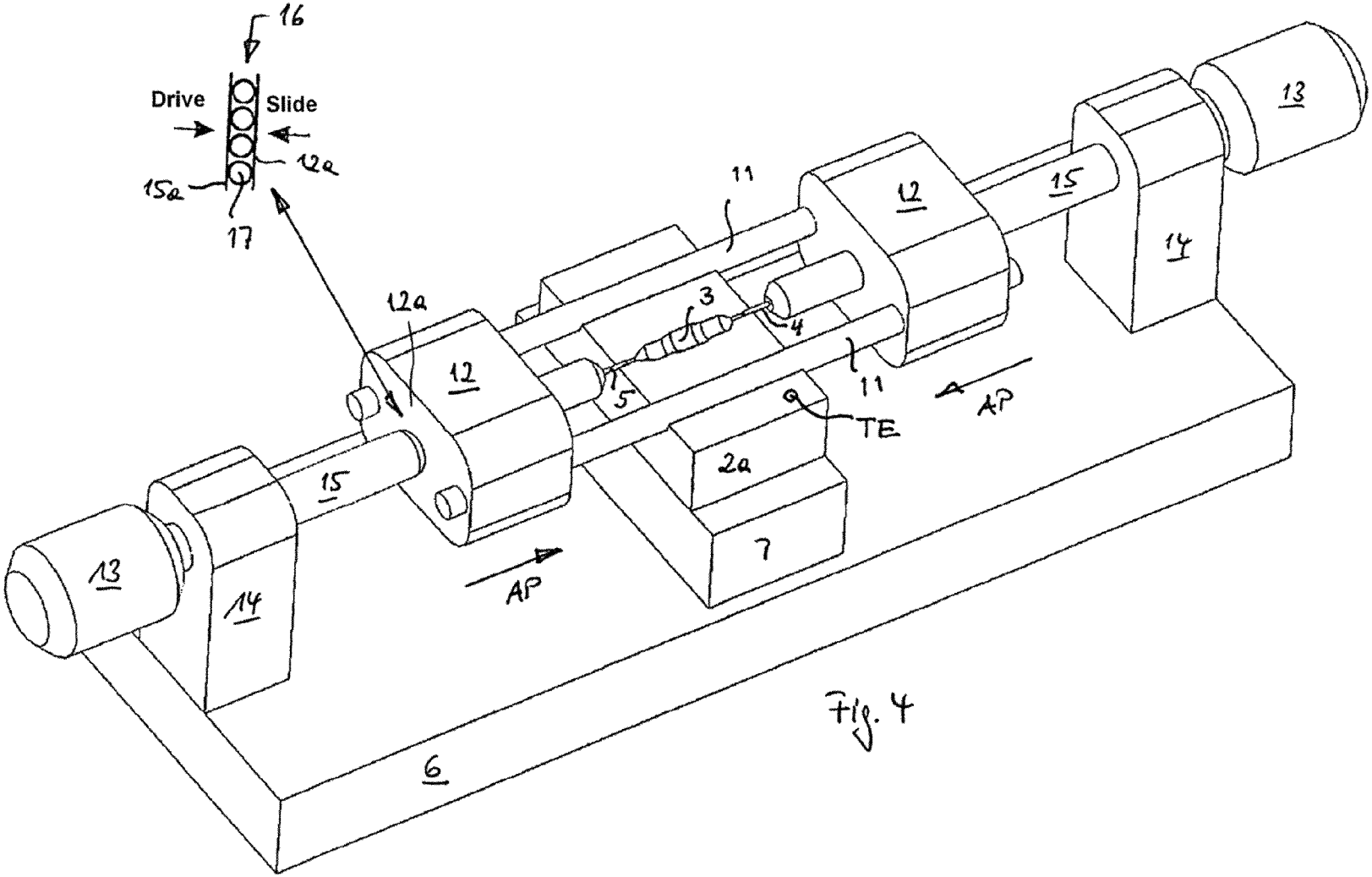
FIG. 4: a perspective diagram as in FIG. 3, however without parts of the apparatus for producing the die-closing force.

The core idea of the invention is shown in FIG. 4, in which the actuator 8 and the frame 9 have been omitted.

According to the invention, two rods 11 extending parallel to each other, which both have a half of their cross-sections set in the lower die part 2*a*, extend through the die 2, or the lower part 2*a* thereof. Furthermore, the rods extend parallel to the longitudinal axis of the die, which is defined by the orientation of the contour 3 and the workpiece that can be inserted therein.

The two rods 11, which project at each end of the die 2, form a guide as defined by the invention, on which a respective slide 12 is guided at each end of the die 2. In this example, the rods 11 can have a round cross-section. It is likewise possible to use a cross-section that deviates from round, or a flat guide.

Both slides 12 have parallel bores through which the rods 11 extend. For example, guide bushings may be fitted in the bores, such as bearings. The passage shown schematically in FIG. 1, or general means for sealing and filling/pressurization, are mounted on the slides 12. In all possible embodiments, the slides can also carry the fluid supply, the fluid is fed to the corresponding ram by a slide.

The rams 12 are adapted to the cross-sectional shape of the ends 1*a* of a workpiece in order to ensure sealing. They can also be conical, or stepped, particularly in order to ensure that additional workpiece material is fed during the forming operation.

The slides 12 can be moved in the direction of the arrow by actuators 13 mounted on both ends and thereby be pressed against the open workpiece ends, which are not shown in this figure, with a contact pressure AP. The actuators may also apply a feed force into the workpiece 1 by the rams 4 and 5.

The actuators 13 are attached to the base plate 6 by respective actuator holders 14. In this way, stresses of the actuators are transmitted to base plate 6, along with the die-closing force. The actuators each move a respective actuator ram 15 whose front face 15*a* presses onto a corresponding face 12*a* of a slide 12 substantially free of lateral forces.

To this end, a direct loose contact may be provided, or, for example, as the detailed drawing shows, a means 16 reducing the lateral force transmission may be provided. Such a means is provided between the faces 15*a* and 12*a*, for example as a roller bearing 16, which comprises a plurality of rollers 17 in a vertical row on top of each other horizontally and perpendicularly to the displacement direction of a slide 12. In this way, the faces 12*a* and 15*a* can glide parallel to each other, particularly vertically past each other, such that forces are transmitted only perpendicularly between the faces, but not vertically, which is to say not in the direction of the die-closing force in which deformations of the die may occur. In the present case, a decoupling in this direction suffices, because a lateral force can occur substantially only vertically.

In this way the invention ensures that, due to a displacement in the parting plane, the slides and the rams attached thereon maintain their relative positions, particularly the concentricity thereof to the workpiece end, because they can move together with the guide 11 provided in the parting plane TE of the die 2, and also that the downward movement of the parting plane TE due to the decoupling vertically does not result in an action of force between the actuator 13 and slide 12, which has a perpendicular part to the shear direction along the guide.

In this way, according to the invention distortions in the die and the guide and leaks between the die or workpiece and ram are avoided. In all embodiments of the invention, workpiece material can be fed by pressing during the forming operation by the rams 4 and/or 5, particularly axially of the workpiece, or exactly perpendicular to the workpiece end opening.

This accuracy also makes it possible to form micro-parts, whose forming was impossible with the known apparatuses.

Figure 5:
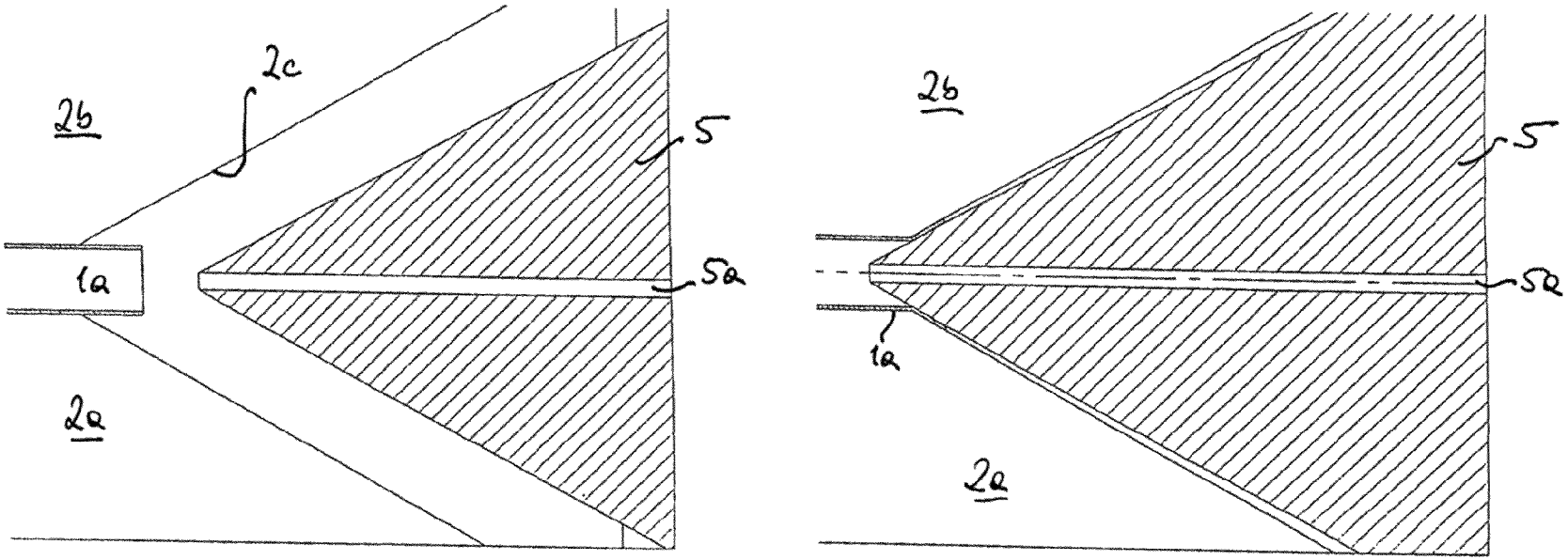
FIG. 5 shows a ram for filling and pressurizing.
Figure 6:
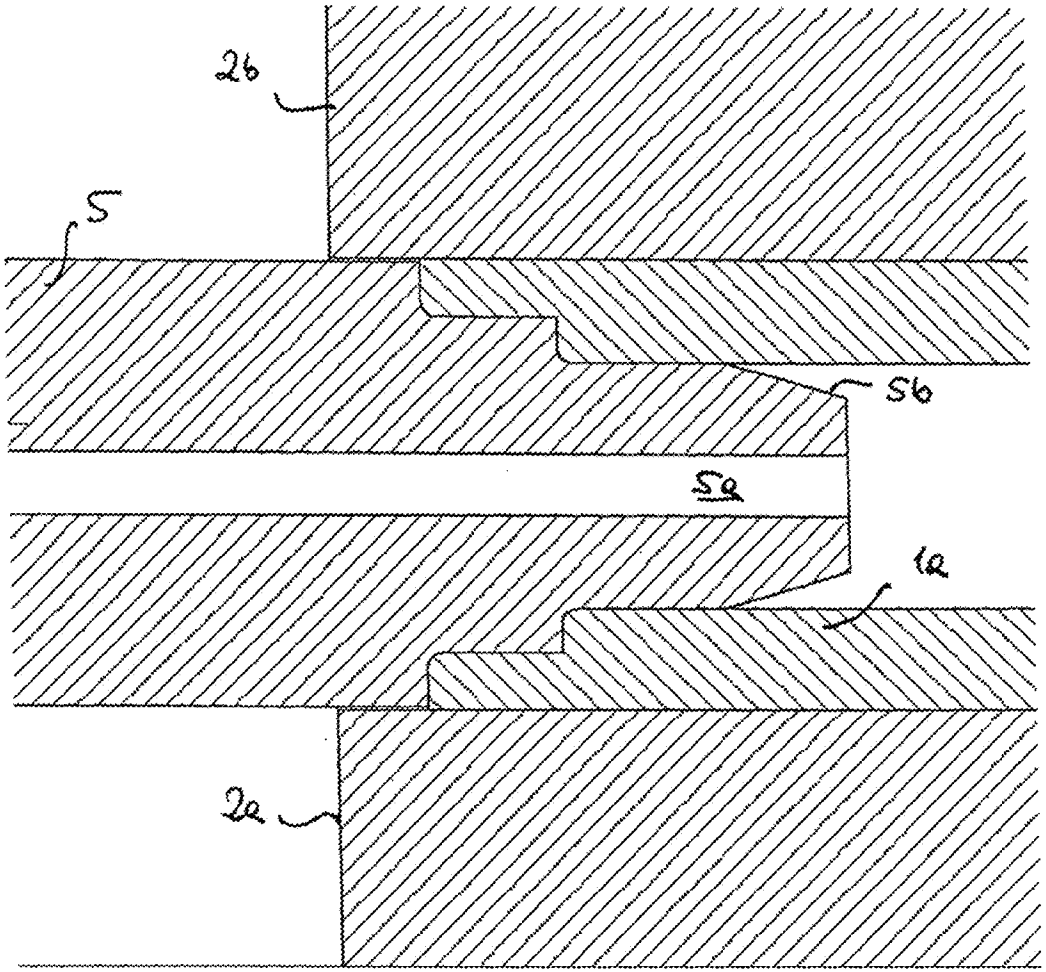
FIG. 6 shows a ram for filling and pressurizing.

FIGS. 5 and 6 show two alternative configurations of a filling and a pressurizing nozzle 5. According to FIG. 5, the nozzle 5 has a tapered, particularly conical tip and a central passage 5*a* opening into the tip. In FIG. 5 shows on the left the position before applying contact pressure to a workpiece end 1*a* inserted in the die 2. The right shows the situation when applying contact pressure. It is apparent that the tip of the nozzle deforms, particularly expands, the workpiece end 1*a*, thereby producing particularly tight contact. Due to the tip, which has more acute conicity (smaller apex angle) than the die region 2*c* around the workpiece end, the workpiece end is clamped between the front end of the tip and the conical workpiece region 2*c*. In this way, optimum positive or non-positive sealing is achieved.

FIG. 6 shows an alternative configuration of the nozzle, or without the passage 5*a* also of the plug 4. Again, the nozzle has a conical tip 5*b* as the stop face in order to enable better penetration into the workpiece end 1*a*. The front end of the ram, just as the end 1*a* of the workpiece 1, is configured to have at least one step. To this end, a step can be formed on the workpiece simply by the face of the end. The ends of the workpiece and ram are complementary to each other in this example and each have two steps.

With this configuration, advantageously the workpiece 1 can be fed during the forming operation by such a ram.

A high-pressure system for the production of pressurized fluid can be configured in the known manner, for example with pumps, filters, and valves.

With respect to all embodiments, it shall be noted that the technical characteristics mentioned in connection with any embodiment can be used not only with that specific embodiment, but also in the other embodiments. All technical characteristics disclosed in this description of the invention shall be considered essential for the invention and can be combined arbitrarily with each other or used alone.

The invention claimed is:

1. An apparatus for hydroforming a part from a tubular workpiece having opposite ends, the apparatus comprising:
- a die having two parts forming a die cavity into which the workpiece can be loaded;
- means for sealing the workpiece at its ends;
- at least one guide mounted on one of the parts of the die;
- a slide displaceable in the guide;
- means carried on the slide for feeding pressurized liquid to one of the ends of the workpiece for internally pressurizing the workpiece; and
- an actuator mounted separately from the guide and coupled to the slide at least substantially free of lateral forces for displacing the slide in the guide.

2. The apparatus according to claim 1 wherein each of the workpiece ends is associated with a respective guide having a respective slide and actuator.

3. The apparatus according to claim 1 wherein the actuator is only connected to the slide for force transmission thereto in one direction so that the substantially lateral force-free coupling between the actuator and the slide is formed by a loose contact between the slide and actuator.

4. The apparatus according to claim 3, further comprising means in the region of the loose contact means for reducing lateral force transmission or friction.

5. The apparatus according to claim 4 wherein the means in the region of loose contact are configured as roller bearings or ball bearings having rollers with a vertical die-closing force oriented horizontally and perpendicular to the slide movement between confronting contact surfaces of the actuator and slide.

6. An apparatus for hydroforming a part from a tubular workpiece having opposite ends, the apparatus comprising:
- a die having two parts joined at a parting plane and forming a die cavity into which the workpiece can be loaded;
- means for sealing the workpiece at its ends;
- at least one guide mounted in the parting plane of the die;
- a slide displaceable in the guide;
- means carried on the slide for feeding pressurized liquid to one of the ends of the workpiece for internally pressurizing the workpiece; and
- an actuator mounted separately from the guide and coupled to the slide at least substantially free of lateral forces for displacing the slide in the guide.

7. An apparatus for hydroforming a part from a tubular workpiece having opposite ends, the apparatus comprising:
- a die having two parts forming a die cavity into which the workpiece can be loaded;
- means for sealing the workpiece at its ends;
- at least one guide extending through the die from one of the workpiece end to the opposite workpiece end;
- a slide displaceable in the guide;
- means carried on the slide for feeding pressurized liquid to one of the ends of the workpiece for internally pressurizing the workpiece; and
- an actuator mounted separately from the guide and coupled to the slide at least substantially free of lateral forces for displacing the slide in the guide.

8. An apparatus for hydroforming a part from a tubular workpiece having opposite ends, the apparatus comprising:
- a die having two parts forming a die cavity into which the workpiece can be loaded;
- means for sealing the workpiece at its ends;
- at least one guide;
- a slide displaceable in the guide;
- two parallel rods outside the die and passing through the slide;
- means carried on the slide for feeding pressurized liquid to one of the ends of the workpiece for internally pressurizing the workpiece; and
- an actuator mounted separately from the guide and coupled to the slide at least substantially free of lateral forces for displacing the slide in the guide.

9. An apparatus for hydroforming a part from a tubular workpiece having opposite ends, the apparatus comprising:
- a die having upper and lower parts forming a die cavity into which the workpiece can be loaded;
- means for sealing the workpiece at its ends;
- at least one guide;
- a slide displaceable in the guide;
- means carried on the slide for feeding pressurized liquid to one of the ends of the workpiece for internally pressurizing the workpiece;
- a common baseplate carrying the lower part of the die; and
- an actuator mounted separately from the guide on the common baseplate and coupled to the slide at least substantially free of lateral forces for displacing the slide in the guide such that die-closing force is applied to the upper part of the die.

10. The apparatus according to claim 9, further comprising a rack/frame arrangement connecting the actuator to the common base plate.

11. An apparatus for hydroforming a part from a tubular workpiece, the apparatus comprising:
- a stationary base;
- a lower die half fixed on the base and having an upwardly open cavity half centered on a horizontal axis;
- an upper die half vertically shiftable above the base, having a downwardly open cavity half, and movable from an upper open position to a lower closed position engaging the lower die half with the die cavity halves fitting together and forming a die cavity, the workpiece being coaxially held in the cavity in the closed position;
- first actuator means for pressing the upper mold half down against the lower die half and thereby clamping the workpiece in the cavity halves in the closed position, whereby with high pressure the upper and lower die halves deform elastically with vertical shortening;
- a guide fixed in the lower die half and extending parallel to the direction in two opposite directions therefrom;
- a pair of slides axially flanking the lower die half and shiftable along the guides;
- a plug tool on one of the slides blockingly engageable in a respective end of the workpiece in the cavity;
- a nozzle tool on the other of the slides axially engageable in an opposite end of the workpiece in the cavity;
- means connected to the nozzle tool for feeding hydraulic liquid under pressure through the nozzle tool and, in the closed position, radially expanding the workpiece into radial engagement with inner surfaces of the cavity;
- respective second actuators fixed on the base axially offset outward from the slides and each having an axially inwardly directed inner face turned toward a respective axially outwardly directed outer face of the respective slide, each of the actuators being axially expandable to operatively engaged the respective inner face axially inward against the respective outer face and thereby press the respective tool against the respective end of the workpiece; and respective coupling means between each inner face and the respective outer face for transmitting axial force from each of the actuators to the respective slide while permitting relative movement transverse to the axis of each inner face relative to the respective outer face.

12. The hydroforming apparatus defined in claim 11 wherein the means for feeding hydraulic fluid is mounted on the other slide.

13. The hydroforming apparatus defined in claim 11 wherein the guide includes two parallel rods fixed in the lower die half and extending slidingly through the slides.

14. The hydroforming apparatus defined in claim 11 wherein the faces are planar and perpendicular to the axis.

15. The hydroforming apparatus defined in claim 11 wherein the coupling means are each a roller bearing.

16. The hydroforming apparatus defined in claim 15 wherein each roller bearing includes a plurality of cylindrical rollers oriented in a vertical row with horizontal rotation axes.

17. The hydroforming apparatus defined in claim 11 wherein the die halves meet in the closed position at a symmetry plane and the guide lies generally on the symmetry plane.

18. The hydroforming apparatus defined in claim 11 wherein the actuators are hydraulic and have respective rams forming the respective inner faces.

19. The hydroforming apparatus defined in claim 11 wherein the nozzle has a frustoconical tip with a predetermined apex angle and the cavity has at the respective workpiece end a frustoconical outer end in which the tip is fit and having an apex angle greater than that of the tip, whereby the respective workpiece end is pinched in annular line contact between the frustoconical tip and the frustoconical outer end.

* * * * *